US005900269A

United States Patent [19]

Duffy et al.

[11] Patent Number: 5,900,269

[45] Date of Patent: May 4, 1999

[54] MECHANISM AND PROCESS FOR COATING THREADED ARTICLES HAVING VARYING EXTERNAL CONFIGURATIONS

[75] Inventors: Richard J. Duffy, Shelby Township; Eugene Sessa, Harrison Township, both of Mich.

[73] Assignee: Nylok Fastener Corporation, MaComb, Mich.

[21] Appl. No.: 08/811,702

[22] Filed: Mar. 5, 1997

[51] Int. Cl.[6] ..... B05D 1/02; B05D 3/02

[52] U.S. Cl. ..... 427/8; 427/195; 427/197; 427/318

[58] Field of Search ..... 427/8, 181, 195, 427/197, 239, 256, 287, 318, 327, 375, 424; 118/668, 669, 676, 305, 315, 319, 209, 238; 411/82, 512, 969, 970

[56] References Cited

U.S. PATENT DOCUMENTS

| | | | |
|---|---|---|---|
| Re. 33,766 | 12/1991 | Duffy et al. | 427/195 |
| 3,787,222 | 1/1974 | Duffy . | |
| 3,830,902 | 8/1974 | Barnes . | |
| 3,858,262 | 1/1975 | Duffy . | |
| 3,995,074 | 11/1976 | Duffy et al. . | |
| 4,701,348 | 10/1987 | Neville . | |
| 4,888,214 | 12/1989 | Duffy . | |
| 5,141,771 | 8/1992 | DiMaio . | |
| 5,280,433 | 1/1994 | Ettinger et al. | 364/468 |
| 5,362,327 | 11/1994 | Sessa . | |
| 5,518,768 | 5/1996 | Wallace et al. | 427/284 |

FOREIGN PATENT DOCUMENTS

| | | |
|---|---|---|
| 1 395 547 | 5/1975 | United Kingdom . |
| 2 286 547 | 8/1995 | United Kingdom . |

*Primary Examiner*—Shrive Beck
*Assistant Examiner*—Fred J. Parker
*Attorney, Agent, or Firm*—Niro, Scavone, Haller & Niro

[57] ABSTRACT

A mechanism and process for coating tapped holes in specialty articles having varying external configurations, such as metal stampings. The specialty article is positioned in a preselected orientation at a loading station, and is then engaged by a carriage assembly and moved from the loading station to a heating station, and then to a spray and discharge station. During movement between stations, the article is maintained in the preselected orientation to allow proper heating and spraying of the tapped holes.

11 Claims, 3 Drawing Sheets

MECHANISM AND PROCESS FOR COATING THREADED ARTICLES HAVING VARYING EXTERNAL CONFIGURATIONS

BACKGROUND OF THE INVENTION

This invention generally relates to a mechanism and a process for coating portions of articles have dissimilar external configurations. More specifically, the invention relates to the application of a thermoplastic layer to coat tapped holes in specialty articles such as metal stampings.

It is well known to apply a thermoplastic resin powder such as nylon to threaded articles to form a "patch" which retards disengagement of the patched fastener with a mating fastener, as shown, for example, in U.S. Pat. Nos. 3,787,222 and 3,858,262. Mechanisms have also been developed for applying a protective coating to standard internally threaded fasteners at relatively high production rates, such as disclosed in U.S. Pat. No. 4,888,214, the disclosure of which is incorporated by reference herein. Similarly, other mechanisms have been developed for applying coatings to both standard and non-standard fasteners at lower production rates, such as disclosed in U.S. Pat. Nos. 5,141,771 and 5,362,327, also incorporated by reference herein.

A common characteristic of the fasteners described in the patents listed above is that they possess only a single tapped hole (e.g., nuts), and their external dimensions are maintained within close tolerances.

There are many specialty articles, such as metal stampings, that contain multiple tapped holes and possess a relatively large variation in their external dimensions. While the tapped or threaded holes of such specialty articles can also advantageously utilize the protective coating or patch described above, prior art coating or patch applicators, including the mechanisms described in the above-referenced prior art patents, typically utilize external dimensions to position the threaded holes with the centerline of corresponding spray nozzles. Unfortunately, this approach is hampered with most stampings, for example, whose external surfaces often have burrs and rough edges which preclude precise positioning from these edges. In the past, to accomplish the coating of articles with varying external dimensions, the coating has been applied to manually positioned articles, at correspondingly low production rates.

It would, therefore, be desirable to provide an automated process, and an automated mechanism, for applying protective coatings or patches to threaded holes in articles having varying external configurations, while also providing a corresponding increase in production rates.

SUMMARY OF THE INVENTION

The present invention preserves the advantages of known mechanisms and methods for coating or patching threaded articles. It also overcomes disadvantages of, and provides new advantages not available with, such mechanisms or methods, particularly when the threaded articles have varying external configurations.

The invention is generally directed to a process utilizing an automated positioning and coating mechanism to apply a thermoplastic material to one or more threaded apertures in a series of articles having varying external configurations. The process uses the apertures in the articles, such as stampings with tapped holes, to properly orient the article. A station is provided for loading each article. The loading station includes one or more pins each sized to receive one of the apertures to be coated, and located in corresponding position to the locations of the apertures. An article is provided to the loading station, and the pins are seated within the apertures of the article to define a preselected orientation for the article. A carriage assembly is provided for engaging the article and for moving the article from the loading station to a heating station while maintaining the article in the preselected orientation. The heating station includes at least one heating element, such as a channel-type induction coil with a pair of legs positioned adjacent the path of travel of the one or more apertures. The heating station is adapted to heat the apertures to a temperature sufficient to melt a preselected thermoplastic resin applied to selected threaded portions of the apertures. Following heating, the article is moved by the carriage assembly to a spray and discharge station while maintaining the article in the preselected orientation. Thermoplastic resin is applied to selected portions of the apertures, and melted and fused while the article is in the spray and discharge station. The article is ejected from the spray and discharge station, a second article is supplied to the loading station, and a thermoplastic material can be applied to successive articles in this manner.

To expedite the process, the carriage can be returned to the loading station during spraying and/or ejection of the article. The distance between each pin is approximately equal to the distance between horizontal legs of the induction coil, as well as the distance between material applicators. The material applicators may take the form of spray nozzles if the thermoplastic material is in powder form, and the number of applicators is preferably equal to the number of pins.

A mechanism for applying a thermoplastic coating to one or more threaded apertures in a series of articles having varying external configurations also forms a part of the present invention. Again, the apertures are used to properly orient the threaded article. A loading station includes one or more pins each sized to receive one of the apertures to be coated. The pins are located in corresponding position to the locations of the one or more apertures. An article is provided at the loading station and corresponding pins are seated within at least two apertures of the first article to define a preselected article orientation for the article. A carriage assembly is used to engage the article and to move the article from the loading station through a heating station while maintaining the article in the preselected orientation. The heating station is positioned adjacent the path of travel of the one or more apertures and is adapted to heat the one or more apertures to a temperature sufficient to melt a preselected thermoplastic resin applied to selected threaded portions of the one or more apertures. A spray and discharge station receives the first article from the heating station while maintaining the first article in the preselected orientation. At the spray and discharge station thermoplastic resin is applied to the aperatures to melt and fuse the resin to at least the selected threaded portions of the apertures, prior to ejection of the article. Successive articles are processed in a similar manner.

BRIEF DESCRIPTION OF THE DRAWINGS

The novel features which are characteristic of the present invention are set forth in the appended claims. The invention itself, however, together with further objects and attendant advantages, will be best understood by reference to the following description taken in connection with the accompanying drawings in which:

DESCRIPTION OF THE PREFERRED EMBODIMENTS

With articles such as stampings having tapped holes, the distance between the tapped holes is typically maintained to a very close tolerance. The present invention makes use of this fact to orient the article with respect to a machine datum prior to coating apertures within the article with a thermoplastic material.

Figure 1:
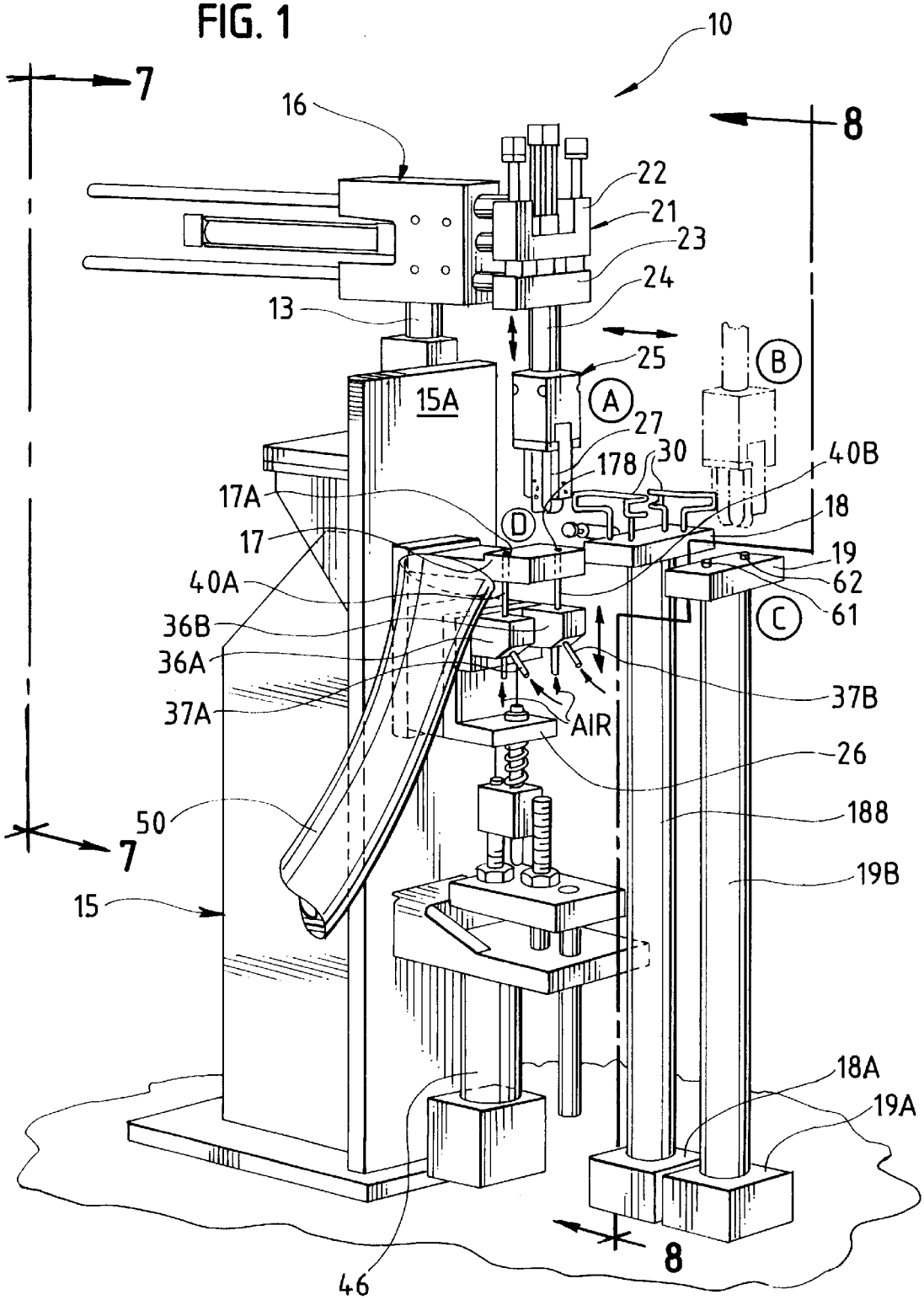
FIG. 1 is a perspective view of a preferred embodiment of the automated mechanism for coating articles of the present invention.
Figure 7:
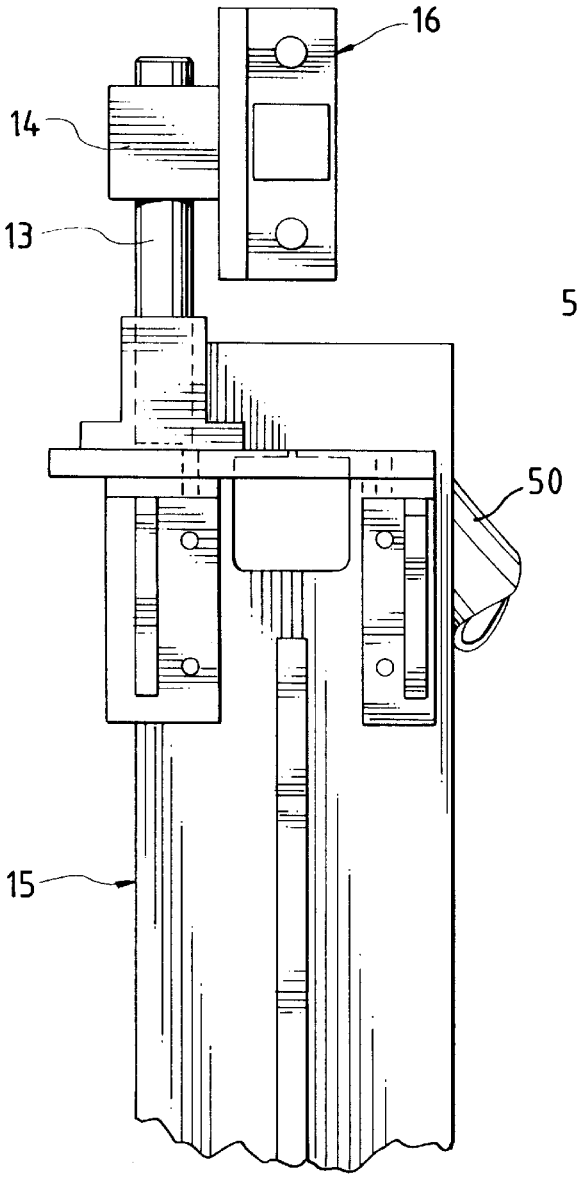
FIGS. 7 and 8 are opposing side views of the mechanism shown in FIG. 1, taken along lines 7—7 and 8—8, respectively.

Referring first to FIG. 1, an automated mechanism, designated generally as 10, forming the preferred embodiment of the present invention is shown. Mechanism 10 includes an upper frame, designated generally as 16, firmly mounted to a lower frame, designated generally as 15, via rod 13. The height of upper frame 16 can be adjusted relative to lower frame 15 by sliding bracket 14 (FIG. 7) relative to rod 13, and then clamping bracket 14 to rod 13 to fix the position (clamping mechanism not shown). Upper frame 16 includes a carriage assembly, generally designated as 21, which moves horizonally relative to the fixed upper frame, in the direction of the arrows. Carriage assembly 21 includes upper bracket 22, lower bracket 23 and gripper assembly 25. Gripper assembly 25 moves vertically due to the vertical stroke of rod 24 within bracket 23. If desired, gripper assembly 25 may also rotate about the axis of rod 24. Gripper assembly 25 includes grippers 27 designed to clamp and hold a stamping 20 in a fixed orientation, relative to both horizontal and vertical planes, during movement of the stamping. Carriage assembly 21 and gripper assembly 25 can be positioned in four basic positions, labeled "A", "B", "C" and "D" on FIG. 1, as further described below.

Figure 2:
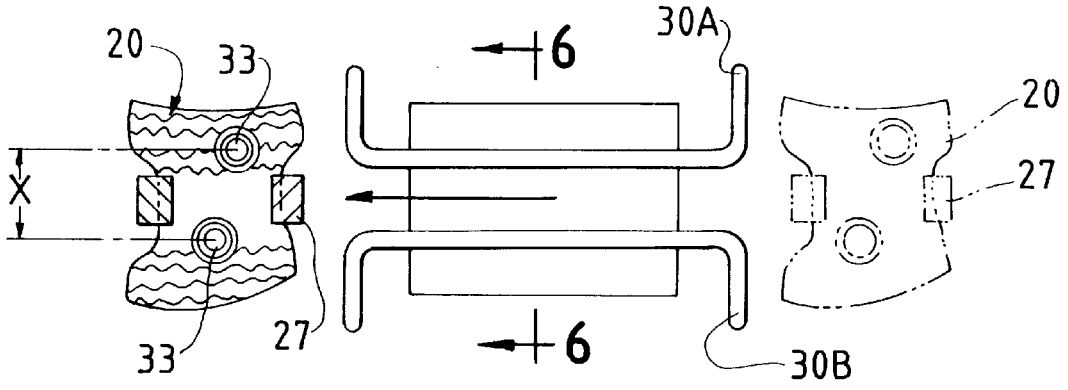
FIG. 2 is a partial top view showing the movement of the article to be coated through the heating coil.
Figure 3:
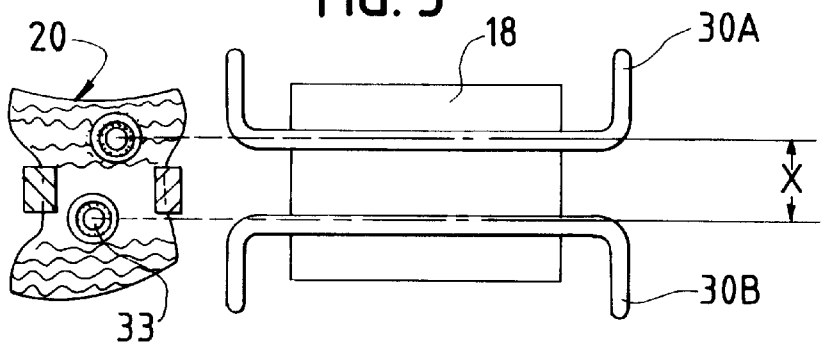
FIG. 3 is a view similar to FIG. 2 showing the article during a coating application.
Figure 6:
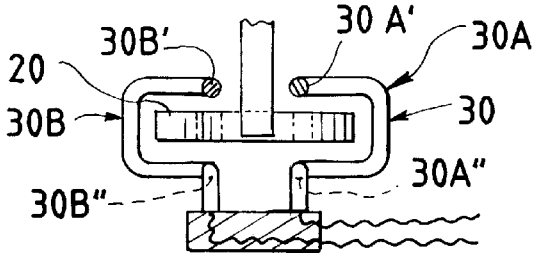
FIG. 6 is a side cross-sectional view taken along reference line 6—6 of FIG. 2, showing a different heating coil embodiment.
Figure 8:
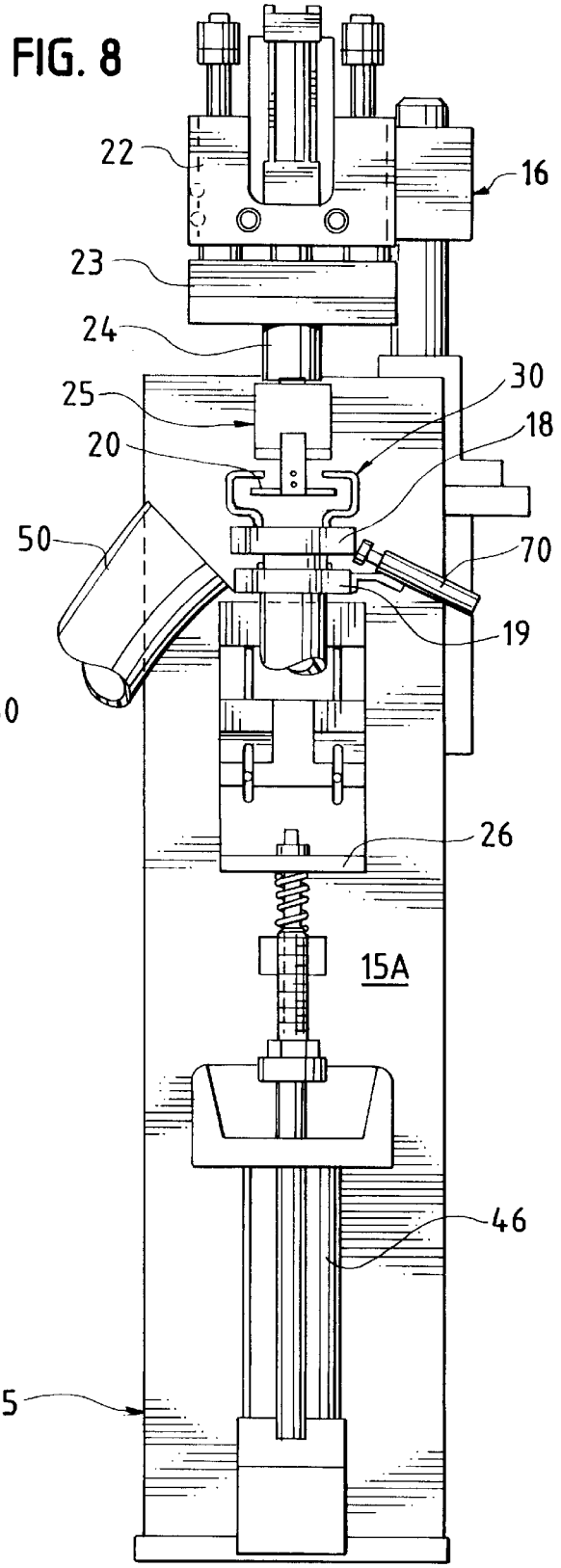

Support plate 17 is fixed to wall 15A of lower frame 15. Plates 18 and 19 are mounted to blocks 18A, 19A and support cylinders 18B, 19B, respectively. Support plates 17 and 19 are mounted at approximately the same height, whereas support plate 18 is mounted at a somewhat greater height. Plate 17 includes apertures for receiving material applicators, such as spray tube nozzles, as described below. Plate 18 supports opposed induction coils 30A, 30B (FIGS. 1–4), and plate 19 is provided with mounting pins 61, 62. (Preferably, as shown in FIGS. 6 and 8, only one induction coil 30 is used, and it can be mounted on a plastic coil support, not shown.) Mounting pins 61 and 62 each have a diameter that is smaller than the minor diameter of the tapped holes 33 of stamping 20 (FIG. 2). Of course, any number of pins, corresponding to the number of aperatures to be coated, can be used. The spacing distance between pins 61 and 62 corresponds to the centerline distance "X" between threaded holes 33 in stamping 20 (FIG. 2). This spacing distance "X" is also approximately equal to the spacing between front and rear induction coils 30A, 30B (FIG. 3), as well as the distance between spray nozzles 40A, 40B and corresponding holes 17A, 17B on support 17 for those spray nozzles (FIG. 1). Thus, when stamping 20 is loaded onto pins 61 and 62, it is accurately positioned for both heating and spraying.

In operation, and referring now to FIGS. 1–6, stamping 20 is initially loaded so that holes 33 are positioned over pins 61 and 62 of support plate 19, thereby generating a signal using, for example a photoelectric sensor or a proximity switch. In response to this signal, gripper assembly 25 moves horizontally from position A to position B, descends to position C, and grippers 27 close on stamping 20. Gripper assembly 25, now carrying stamping 20, retracts to position B. In position B stamping 20 is elevated to the centerline between the horizontal surfaces or legs 30A', 30A" and 30B', 30B" of induction coils 30 (FIG. 6). As will now be understood, proper orientation of the threaded article facilitates localized heating of the article in the area where the threaded apertures are located.

The gripper assembly then returns horizontally to position A, thereby causing the stamping to pass between the upper and lower legs of induction coil 30, heating the apertures to the proper temperature for melting the coating. When the heated stamping reaches position A, gripper assembly 25 then descends to position D. In position D, grippers 27 open and, with the help of a magnet located mid-way between holes 17A, 17B in plate 17 (not shown), deposit stamping plate 20 in the same orientation (vis-a-vis tapped holes 33), termed here the "spray position", as stamping 20 was in when it was first gripped in position C, termed here the "loading position".

When stamping 20 is in the spray position, a signal is given to Allenair cylinder 46 to complete a cycle. This results in spray blocks 36A, 36B sliding upward relative to L-shaped frame 26, thus causing spray tubes 40A, 40B (FIG. 1) to rise into holes 33 of stamping 20. A powder/air mixture now passes through powder supply tubes 37A, 37B in the direction of the arrow (powder feeder not shown), through spray tubes 40A, 40B and onto tapped holes 33 at the appropriate time in the cycle. Powder overspray collectors can be employed and appropriately positioned, as is well known in the art. After the coating application, the spray tubes descend out of the stamping plate, and the plate is ejected from the spray position by, for example, using forced air, a camming mechanism, or an air cylinder 70 (FIG. 8). Ejection of the coated stamping preferably occurs at the same time that gripper assembly 25 is moving back to position C to engage the next article to be coated.

Figure 4:
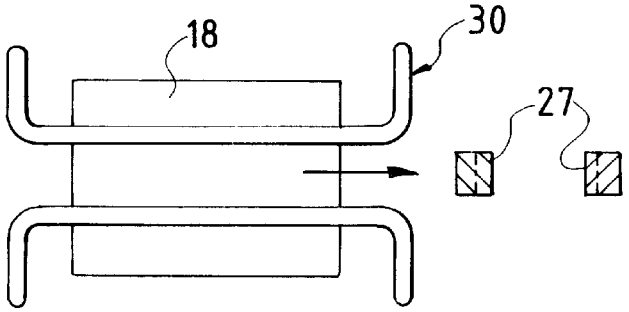
FIG. 4 is also a view similar to FIG. 2, showing ejection of the coated article.
Figure 5:
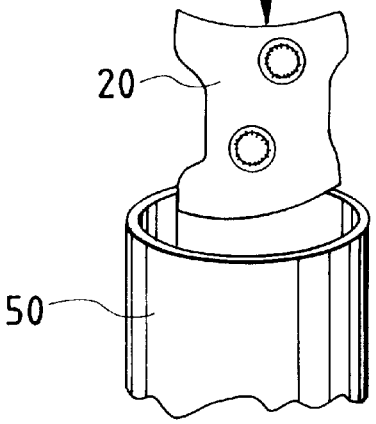
FIG. 5 is a perspective view of the article during ejection.

After coating or patching of the tapped holes in the stamping, the stamping is ejected or discharged from position D. An air cylinder is preferably used for this purpose, and stampings 20 can be ejected into discharge tube 50, as shown in FIGS. 1 and 4.

In the preferred embodiment, induction heat for induction coil 30 is supplied by a Lepel LSS-15KW, 50 KHz to 200 KHz induction generator. Powder is supplied and metered by an AccuRate Model 302 dry material feeder, and applied in the usual manner (see, e.g., U.S. Pat. No. Re. 33,766). Applications of liquid coatings may also be made using, for example, the liquid coating application device shown in FIGS. 9–16 of copending and commonly assigned U.S. Ser. No. 08,779,684, filed Jan. 7, 1997 and titled "Method And Apparatus For Applying A Coating To The Head/Shank Junction Of Externally Threaded Fasteners", the disclosure of which is hereby incorporated by reference herein.

The motions of mechanism 10 can be controlled by a GE Fanuc, Series 90 TM Micro Programmable Logic Controller. Signals may be provided by a combination of proximity sensors and photoelectric controls.

Using the automated mechanism of the present invention, the tapped holes of stampings with varying external configurations have been coated at rates far exceeding the rates previously possible from manual processing.

Various materials can be used to coat or patch the stamping holes, including polyamide resins such as nylon for (e.g.) self-locking and anti-vibratory purposes polyphthalamide resins such as NYTEMP® available from Nylok Fastener Corporation for (e.g.) similar but high-temperature applications, fluorocarbon powders such as, NYCOTE® (also available from Nylok) for (e.g.) protection against anti-corrosive or paint applications, or other thermoplastics or fluoropolymers, in either powder or liquid form. It will be apparent to those of ordinary skill in this art that, depending upon the particular coating material chosen, its purpose, and the form in which it is applied (i.e., powder or liquid), the artisan may choose to employ heating either prior to or following the coating application, or during both time periods.

It will be understood that the invention may be embodied in other specific forms without departing from its spirit or central characteristics. Thus, while a preferred embodiment specifically disclosed here is designed to apply a protective, contaminant-inhibiting coating to the tapped holes of stampings, it will be appreciated that the principles of the present invention can be advantageously employed to provide, for example, a polyamide (e.g., nylon) or polyphthalamide resin patch to threaded apertures in stampings or other articles, as well. The present examples and embodiments, therefore, are to be considered in all respects as illustrative and not restrictive, and the invention is not to be limited to the details given here.

We claim:

1. A process utilizing an automated positioning and coating mechanism to apply a thermoplastic material to two or more threaded apertures in a series of articles having varying external configurations, using the apertures to properly orient the mechanism, comprising the steps of:

a. providing a station for loading each article, the loading station including two or more pins each sized for placement with an aperture to be coated, the two or more pins being located in corresponding position to the locations of the two or more apertures;

b. providing a first article at the loading station, and seating the two pins within corresponding apertures of the first article to define a preselected orientation for the first article;

c. providing a carriage assembly for engaging the first article and moving the first article from the loading station to a heating station while maintaining the article in the preselected orientation, the heating station including at least one heating element positioned adjacent the path of travel of the first article for heating the apertures to a temperature sufficient to melt the thermoplastic material to selected threaded portions of the apertures;

d. after heating the apertures, applying the thermoplastic material to at least selected portions of the apertures while the thermoplastic material is at a temperature sufficient to melt and fuse the material to the at least selected portions of the apertures, and while maintaining the first article in the preselected orientation;

e. returning the carriage assembly to the loading station and supplying a second article to the loading station; and f. repeating steps b.–e. to apply the thermoplastic material to the threaded apertures of further articles.

2. The process of claim 1, wherein the carriage assembly is returned to the loading station in response to a signal indicating the presence of the second article.

3. The process of claim 1, wherein the thermoplastic material is applied using a number of spray nozzles equal to the number of apertures.

4. The process of claim 3, wherein each spray nozzle is inserted within a corresponding threaded aperture of the fastener.

5. The process of claim 3, wherein the distance between each pin is equal to the distance between the spray nozzles.

6. The process of claim 1, further comprising the step of unloading an article having apertures coated with the thermoplastic material by applying pressurized air to the article using an air cylinder.

7. The process of claim 1, wherein the at least one heating element comprises an induction coil having opposing horizontal surfaces, and wherein the distance between each pin is approximately equal to the distance between the opposing horizontal surfaces of the coil.

8. The process of claim 1, wherein the thermoplastic material comprises a fluoropolymer coating for protection against paint or anti-corrosive applications.

9. The process of claim 1, wherein the thermoplastic material comprises a nylon patch.

10. The process of claim 1, wherein the carriage assembly is returned to the loading station simultaneous with the application of the thermoplastic material to the two or more apertures.

11. A process for using a positioning and coating mechanism to apply a thermoplastic material to two or more threaded apertures in a series of articles having varying external configurations, using the apertures to properly orient the mechanism, comprising the steps of:

a. loading an article using two or more pins each sized for placement within the apertures to be coated, the two or more pins being located in corresponding position to the locations of the apertures, wherein a corresponding pin is seated within an aperture of a first article to define a preselected orientation for the first article;

b. providing a carriage assembly for engaging the first article and moving the first article, while maintaining the first article in the preselected orientation, to a spray location where the thermoplastic material can be applied to at least selected portions of the two or more apertures;

c. using the carriage assembly to move the first article from the spray location to a heating station while maintaining the first article in the preselected orientation, the heating station including at least one heating element positioned adjacent the path of travel of the first article for heating the two or more apertures to a temperature sufficient to melt and fuse the thermoplastic material previously applied to the at least selected portions of the two or more apertures; and d. repeating steps a.–c. to apply the thermoplastic material to the apertures of further articles.

* * * * *